United States Patent [19]

Pujals, Jr.

[11] 4,411,258

[45] Oct. 25, 1983

[54] METHOD AND DEVICE FOR RELIEVING PAIN

[76] Inventor: Charles Pujals, Jr., 119 Fayette St., Bridgeton, N.J. 08302

[21] Appl. No.: 365,459

[22] Filed: Apr. 5, 1982

Related U.S. Application Data

[63] Continuation-in-part of Ser. No. 129,154, Mar. 10, 1980, abandoned.

[51] Int. Cl.[3] ..... A61H 7/00

[52] U.S. Cl. ..... 128/60; 128/303 R

[58] Field of Search ..... 128/25 B, 60, 61, 62 R, 128/67, 303 R, 63, 117

[56] References Cited

U.S. PATENT DOCUMENTS

| | | | |
|---|---|---|---|
| 1,554,510 | 9/1925 | Kirby | 128/62 R |
| 1,605,959 | 11/1926 | Lefevise | 128/62 R |
| 2,220,836 | 11/1940 | Closson | 128/62 R |
| 2,250,267 | 7/1941 | Lins | 128/132 |
| 2,868,191 | 1/1959 | Juhasz | 128/60 |
| 3,100,483 | 8/1963 | Altmeyer et al. | 128/60 |
| 3,116,735 | 1/1964 | Geimir | 128/426 |
| 3,434,469 | 3/1969 | Swift | 128/78 |
| 3,521,623 | 7/1970 | Nichols | 128/78 |
| 3,554,190 | 1/1971 | Kaplan | 128/78 |
| 3,578,773 | 5/1971 | Schultz | 128/78 |
| 3,605,731 | 9/1971 | Tigges | 128/24 |
| 3,901,234 | 8/1975 | Yazawa | 128/268 |
| 3,915,163 | 10/1975 | Sakamura | 128/95 |
| 3,987,787 | 10/1976 | Boxer | 128/1 R |
| 4,022,197 | 5/1977 | Castiglia | 128/101 |
| 4,121,582 | 10/1978 | Remiro | 128/157 |

*Primary Examiner*—Michael H. Thaler
*Attorney, Agent, or Firm*—Bernard Stickney

[57] ABSTRACT

A method and device for relieving pain such as in the lower back by applying a peripheral modulation pad having a plurality of generally pointed projections to apply an intense painful stimulation resulting in a physiological response at the spinal cord entry level and the brain stem to block the pain. The projections are structured and spaced in a manner so as not to puncture the skin or to be unbearable. The pad is attachable to a belt-like binder and has relatively thin and thick portions to help conform to the body and to further permit toleration of the intense stimulation.

7 Claims, 4 Drawing Figures

METHOD AND DEVICE FOR RELIEVING PAIN

This is a continuation-in-part of U.S. application Ser. No. 129,154, filed Mar. 10, 1980, now abandoned.

BACKGROUND OF THE INVENTION

A backache is a common syndrome characterized by pain and tenderness arising from skeletal muscles, their fibrous or tendinous attachments and apophyseal joint capsules. The pain is experienced deep in the skin, is not localized, and is characteristically of a dull, aching quality.

Pain production involves the nociceptor system. The system is triggered by an abnormal state in the tissue it envenerates. Pain is almost always found with mechanical disfunction of neuromuscular tissues. The progressive pain syndrome has a deleterious effect on the apophyseal joint capsule, the related striated musculature and the arthrokinetic reflex system. This results in inhibition of the spinal extensor muscles, or if very painful, a co-contraction of flexor and extensor trunk muscles resulting in paravertebral muscle spasm.

One of the oldest forms of pain relief is hyperstimulation analgesic as in stimulation of myofascial trigger points by dry needling acupuncture, intense cold, intensive heat or chemical irritation as in mustand plasters. This relief of pain by distant trigger points has been called the gate control theory. Brainstem areas are known to exhibit a powerful inhibiting control over transmission in the pain signalling system. These areas may be considered a central biasing system receiving inputs from widespread parts of the body and projecting to widespread parts of the spinal cord and brain. The stimulation of particular nerves or tissues could bring about an increased input to the central biasing mechanism which would close the gate to inputs from selected body areas.

Further, the analgesia-producing areas of the brainstem are known to be sensitive to morphine. In the recent treatment by electroacupuncture of patients with chronic pain there has been an increase in endogenous morphine-like compounds (endorphins) in their cerebrospinal fluids.

The present invention is based on the concept that intense stimulation by a peripheral modulation pad activates a neural feedback loop through the brainstem analgesia-producing areas. The relief of pain improves the articular receptor systems which influence the function of the apophyseal joint capsules, the related striated muscles and the arthrokinetic reflexes, thus facilitating active or passive corrective exercise. While this invention is described herein as directed primarily to the relief of backache, it also applies to the relief of the pain in other areas of the body.

A binder or belt having massaging cleats and having provision for spacing the belt from the body to permit free circulation of air taught by U.S. Pat. No. 1,605,959 of Lefevre, issued Nov. 9, 1926. The recommended construction of the device disclosed in said patent uses flat studs of nonuniform height and spacing. As will be made clear hereinafter, the device of said patent cannot perform in the same manner as the present invention.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE PREFERRED EMBODIMENTS

Figure 1:
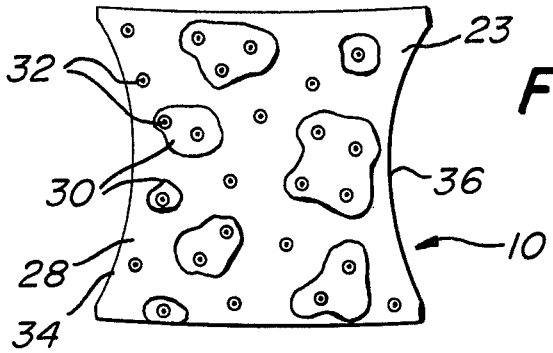
FIG. 1 is a front elevation view of a first imbodiment of a peripheral modulation pad in accordance with the present invention.

Referring to the drawings in detail, wherein like numerals indicate like elements, there is shown in FIG. 1 a peripheral modulation pad of the present invention designated generally as 10.

Figure 2:
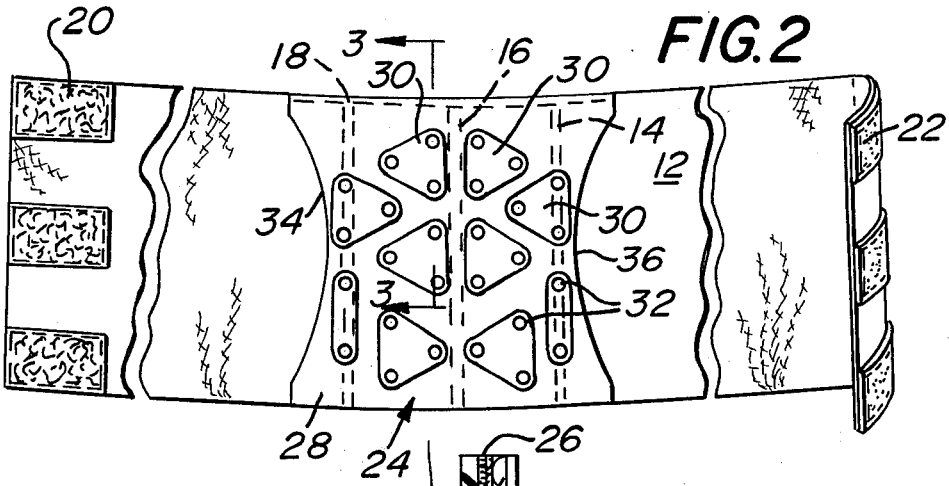
FIG. 2 is a front elevation view, partly in perspective, of the belt illustrating the inner or front surface of a second embodiment of a peripheral modulation pad of the present invention.

The peripheral modulation pad, more particularly designated as 23 in FIG. 1 may be made of any flexible material and shaped to conform to a painful body portion of the user. As illustrated in FIGS. 1 and 2, the pad is shaped to conform to a person's lower back region. The peripheral modulation pad 23 is preferably made from a polymeric plastic material such as vinyl. Preferably the pad has a non-uniform thickness. The thick portions are designated 30 and the thin portions are designated 28. As illustrated, the pad 23 includes a plurality of isolated thick portions 30. Thick portions 30 may, if desired, be interconnected by a narrow web.

Each of the thick portions 30 is provided with at least one pointed projection 32 and preferably is provided with between one and four projections 32. The pad 23 is sufficiently flexible so as to readily conform to the shape of the body. The curved side edges 34, 36 facilitate ease of accomplishing such conformation. The thick portions 30 provide sufficient mass and ridigity so that the projections can perform their intended function. The pad 23 is preferably constructed of material having relatively thick areas 30 and relatively thin areas 28 to give better modulation. Thus, the thin areas 28 are generally more flexible than the thick areas 30, and help generate a modulating or undulating motion of the pad in relation to the body portion against which it is placed to better stimulate the skin of the body portion. The thick areas 30 may have random shaped and may be spaced at random locations with respect to thin areas 28. The spacing of the projections 32 is the important aspect as described hereinafter.

As illustrated in FIG. 1, projections 32 may be located both on the thin areas 28 and on the thick areas 30 of pad 23, and may have a random pattern. Alternatively, projections 32 may be located only on the thick areas 30 of the pad, as illustrated in FIG. 2. The projections may have a random orientation or may be oriented in a predetermined pattern to concentrate pressure and stimulation in a particular region of a wearer's body portion. A preferred approximate thickness for the thinner portions 28 is 0.030 to 0.040 inches with the thicker portions 30 having a thickness of about 0.070 to 0.080 inches. The projections 32 preferably have a base diameter corresponding generally to the height of the projections, such as a base diameter of about $\frac{1}{8}$ inch and a height of about $\frac{1}{8}$ inch.

An alternate embodiment of a peripheral modulation pad is illustrated in FIG. 2 and designated generally as 24. FIG. 2 also illustrates the pad 24 as being removably attachable to a belt-like binder (hereinafter "belt") 12 so the pad 24 may be held securely against a wearer's body. A corset or brace may also secure the pad.

In the embodiment illustrated in FIG. 2, a wide belt 12 preferably is made from an elastomeric material having one or more reinforcements in a central area thereof. As illustrated, the belt 12 has bone or metal reinforcements 14, 16 and 18 and therefore, is technically a corset or brace. At one end of the belt 12, the inner surface thereof is provided with attachment means 20. On the outer surface at the other end of the belt 12, there is provided an attachment means 22. The attachment means 20, 22 cooperate to retain the belt in a body encircling position. Attachment means 20, 22 are preferably cooperative fibers of the type sold commercially under the trademark VELCRO, but may be snaps, buttons, a zipper or other suitable fastener.

The peripheral modulation pad 24 can be removably attached to the belt 12 such as, for example, by being attached adjacent the upper edge thereof. Thus, mating fiber-like members of the type sold commercially under the trademark VELCRO or other fasteners are attached to both the belt 12 and the rear surface of the upper edge of the pad 24. In this manner, the pad 24 may be removed when there is no longer a need for the same. The pad is preferably retained on the belt 12 by way of strips 26 sewn or adhesively secured across the entire upper edge of the pad 24 with a mating structure on the inner surface of the belt 12.

Figure 4:
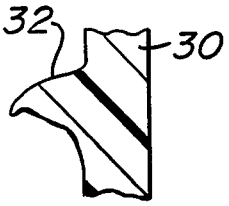
FIG. 4 is an enlarged detail view of a projection on the inner surface of a peripheral modulation pad.

In the embodiment of the pad illustrated in FIG. 2, the thick portions are generally arranged in the form of triangles. It should be noted that there are generally vertical and horizontal rows of projections 32. The projections 32 on each of thick portions 30 are preferably equidistant from one another with the distance between projections 32 being approximately 1.375 inches. The projections 32 are preferably cone-shaped with an extended teat which is easily deflected to one side as shown more clearly in FIG. 4 so as not to result in a sharp rigid point which could pierce the skin. Nevertheless, the projections should be generally pointed to provide the intense stimulating to the skin. Once the teat is deflected to one side, the remainder of the projection 32 offers resistance to deflection. The pad 24 is preferably provided with curved concave side edges 34 and 36 as shown more clearly in FIG. 2.

To relieve pain as in the lower back area, the pad 24 is placed in that area so that the projections 32 will create an intense stimulation sufficient to elicit the neural feedback to the brainstem an analgesia-producing areas referred to above.

The peripheral modulation pad is designed so as to stimulate many areas of the skin as the wearer moves. These independent stimuli prevent accommodation of the nervous system to the pressure of the projections. Uniform pressure is aided by the reinforcements 14, 16 and 18 and the tightness with which the belt 12 encircles the waist. The attempted withdrawal of the body tends to improve extension of the lower back and trunk and therefore return of function at the apophyseal level.

When the pad is constructed as described above it is tolerable to the wearer. The teats prevent any puncturing of the skin. The spacing of the projections is in accordance with the psychophysical phenomenon of two point discrimination. Thus two adjacent pricks only feel as one although each is active in stimulating the skin on the back.

The present invention does not interfere with freedom of body motion which is important. It is suggested that the wearer wear a a cotton undershirt so that increased sweat can be absorbed. The present invention is easily constructed so as to be of different sizes such as small, medium and large for different sized persons. When the back or other body portion no longer aches, the wearer say easily remove pad 24 but may continue to wear the belt 12 for additional support if desired.

Figure 3:
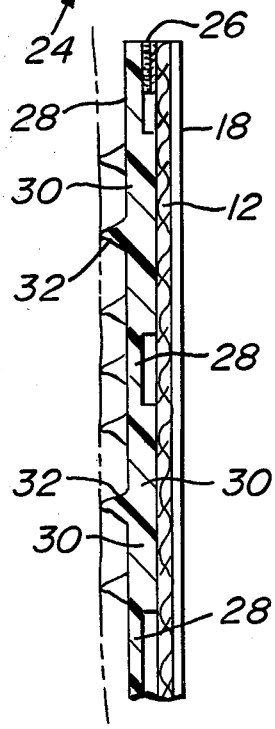
FIG. 3 is a sectional view taken along the line 3—3 in FIG. 2 but on an enlarged scale.

As illustrated in FIG. 3, the thickness of strips 26 for securing the pad 24 to the belt 12, combined with the thickness of the thin portions 28, corresponds generally to the thickness of the portions 30. This avoids the presence of a hump or ridge at the upper edge of the device which could be a source of irritation. The height of the peripheral modulation pad 24 may vary but should extend from the lumbar spinal area down through the upper sacral vertabrae when used to relieve lower back pain.

The present invention can be suitably modified, as required, for use as a thoracic or cervical applicance or to conform to the shape of other body portions to be treated.

The present invention may be embodied in other specific forms without departing from the spirit or essential attributes thereof and, accordingly, reference should be made to the appended claims, rather than to the foregoing specification, as indicating the scope of the invention.

I claim:

1. A device for relieving pain comprising a flexible peripheral modulation pad having patterns of thicker and thinner areas adapted to conform to the shape of a portion of a person's body, means for providing an intense stimulation to activate a neural feedback loop through brainstem analgesia-producing areas to provide relief from pain when said pad is bound to the body portion, including 1 to 4 cone-like pointed projections with an extended teat to prevent puncturing the skin, the height of the projections being uniform, the distance between adjacent projections being substantially equal and on the order of one inch to about 2 inches whereby the person perceives the projections to be less than the actual number contacting the body portion.

2. A device as defined in claim 1 wherein the flexible pad has means for releasably attaching it to an elastic binder for circumscribing a person's body to secure it against said body portion.

3. A device as defined in claim 1 wherein said projections are arranged in vertical and horizontal rows, the projections in adjacent horizontal rows being staggered and the projections in adjacent vertical rows being staggered.

4. A device as defined in claim 1 wherein said distance between adjacent projections is approximately 1.375 inches.

5. A device as defined in claim 1 wherein said flexible pad has curved concave side edges so that the top and bottom portions are wider than the central portion of said pad.

6. A peripheral modulation pad adapted to be attached to a binder for circumscribing a person's waist comprising a flexible member of non-uniform thickness so as to have thick portions and thin portions, the thicker portions having a plurality of generally pointed projections integral therewith, the thin portions being entirely free of projections, the height of the projections being uniform and the thicker portions being arranged in a pattern to provide intense stimulation to the lower back area.

7. A peripheral modulation pad as defined in claim 6 wherein said projections are arranged in horizontal and vertical rows, said flexible member being a polymeric plastic and having curved concave side edges so that the central portion is narrower than the top and bottom portions of said member.

* * * * *